United States Patent [19]

Paccione

[11] 4,289,153

[45] Sep. 15, 1981

[54] HAIR STYLING DEVICE

[76] Inventor: Anthony Paccione, 1681 65th St., Brooklyn, N.Y. 11204

[21] Appl. No.: 153,972

[22] Filed: May 28, 1980

Related U.S. Application Data

[63] Continuation-in-part of Ser. No. 930,024, Aug. 21, 1978, abandoned.

[51] Int. Cl.[3] ..... A45D 44/18
[52] U.S. Cl. ..... 132/85
[58] Field of Search ..... 132/85, 112–114, 132/148, 160

[56] References Cited

U.S. PATENT DOCUMENTS

| | | | |
|---|---|---|---|
| 2,455,600 | 12/1948 | Molumby et al. | 132/84 R |
| 2,617,431 | 11/1952 | Gaspari | 132/112 X |
| 2,829,655 | 4/1958 | Bau | 132/85 |
| 3,406,694 | 10/1968 | Odence | 132/85 |

*Primary Examiner*—G. E. McNeill
*Attorney, Agent, or Firm*—Jordan and Hamburg

[57] ABSTRACT

Hair styling device comprises an elongated handle member having a rigid hollow body divided into two chambers by a common end wall for storage of two kinds of liquid therein and a hair manipulating member. Pump and nozzle assemblies located in detachable cap members operated by pushing them in the longitudinal direction.

2 Claims, 4 Drawing Figures

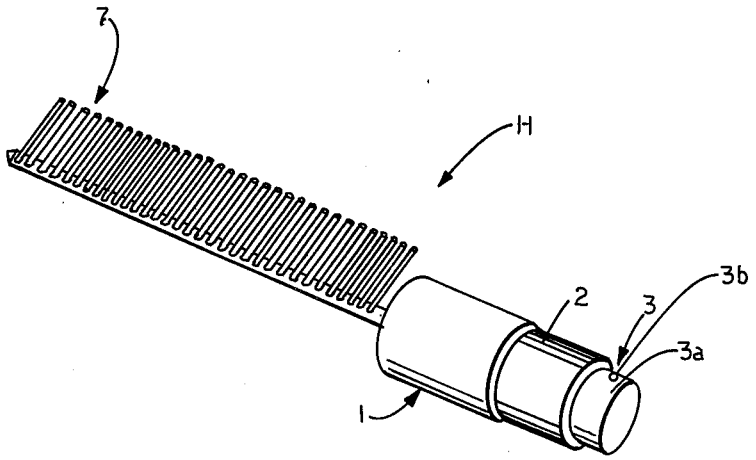
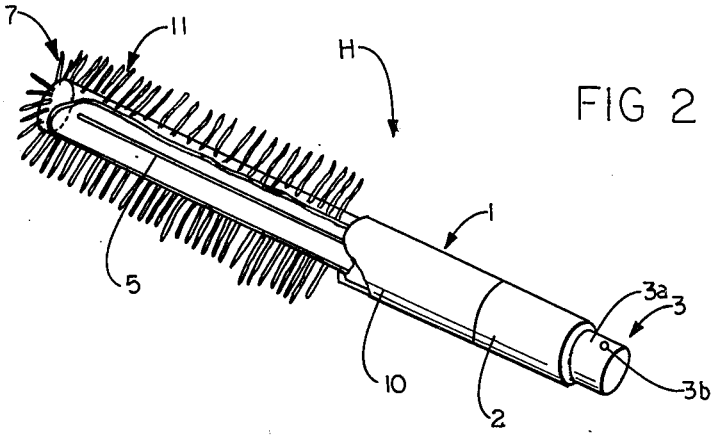
FIG 2
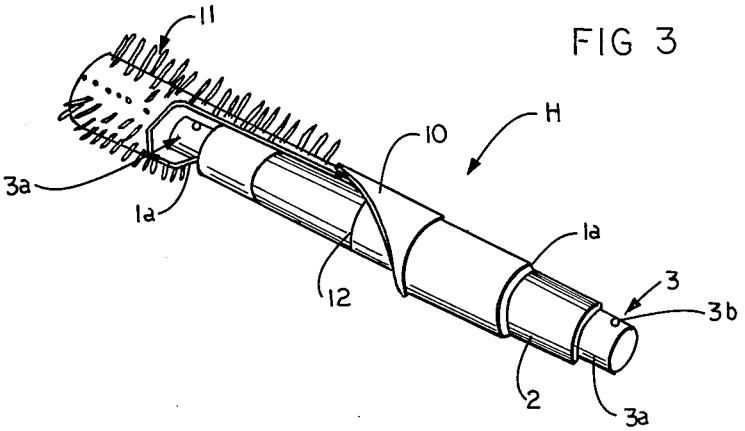
FIG 3
FIG 4

HAIR STYLING DEVICE

RELATED APPLICATIONS

This is a continuation-in-part of pending application Ser. No. 930,024 now abandoned filed Aug. 21, 1978 and claims the benefit of the filing date thereof for all commonly disclosed subject matter.

BACKGROUND OF THE INVENTION

The present invention relates to hair styling devices and more particularly to a hair styling device in which a hair manipulative member such as a comb or brush is connected to a hollow handle in which a liquid is stored and can be selectively discharged in the form of a spray by means of a pump and nozzle carried by the handle.

It has been appreciated heretofore that there is great inconvenience in having to carry separately a bulky styling brush or comb and a container of a liquid such as a hair setting lotion in order to maintain one's hair in a well groomed condition while away from home. Thus, various devices have been available prior to this invention whereby a hair manipulative member and a hair treating liquid have been provided in a combined article. U.S. Pat. No. 3,406,694 issued Oct. 22, 1968 to L. A. Odence discloses a combination hairbrush-applicator in which there is rigidly connected a bristle portion and a handle. The handle is given a hollowed out portion and a pressurized cartridge such as an aerosol is incorporated within such portion of the handle. U.S. Pat. No. 3,960,160 issued June 1, 1976 to Gary LaDon Hogan discloses a hair treatment appliance in which a body has a hollow compartment for reception of an aerosol container and slots in the wall of the body for manipulation of the aerosol and the discharge of a liquid spray. A comb is secured to one end of the body and hair lifter elements are provided at the other end. Other prior art devices are disclosed in U.S. Pat. No. 1,714,556 which discloses a toilet article such as a brush or comb having on the opposite side a reservoir for liquid and means for producing a spray of the liquid; U.S. Pat. No. 1,323,463 discloses a pocket comb having a cover and a pocket engaging grip. U.S. Pat. No. 2,796,070 discloses a brush having a cover or housing case for the brush. The hollow handle is used to house a container. U.S. Pat. No. 3,843,990 discloses a cylindrical hair brush. U.S. Pat. No. 3,102,544 discloses a grooming device utilizing a comb the dorsal section of which has a longitudinal chamber which houses a thin cylindrical aerosol cartridge of the hair dressing type which is replaceable. U.S. Pat. Nos. 2,998,822; 3,516,424 and 3,856,027 show various hair grooming aids which utilize a chamber for the storage and expulsion of a liquid grooming aid.

The use of aerosols has been recognized as being of a hazardous nature owing to the requirement for a fluorocarbon propellant. Also, hair styling devices relying upon the use of such aerosols are confined in terms of design to the sizes and configurations of commercially available aerosol containers. There is also a continuing need for a hair styling device which is compact and can nevertheless provide more than one type of hair treatment liquid.

SUMMARY OF THE INVENTION

One object of the invention is to provide a hair styling device which incorporates in a single combined article a hair manipulative member and a supply of a hair treatment liquid which can be selectively sprayed upon the hair, such article being compact and not restricted in design to the use of commercially available aerosol containers.

Another object of the invention is the provision of a hair styling device which is compact and affords the user the option of more than one hair treatment liquid.

Other objects and advantages of the invention will become readily apparent to persons versed in the art from the ensuing description of the invention.

In accordance with the invention there is provided a hair styling device comprising a hair manipulative member such as a comb or brush and a handle connected at one end thereof to such hair manipulative member. The handle is hollow to accomodate a hair treatment liquid therein. The one end of the handle at which it is connected to the hair manipulative member is closed whereas the other end thereof is open for the charging of the liquid. A cap closes the open end of the handle and supports a pump and nozzle for the selective discharge of liquid from the handle in the form of a spray.

BRIEF DESCRIPTION OF THE DRAWINGS

In order that the invention may be more fully comprehended it will now be described, by way of example, with reference to the accompanying drawings in which:

FIG. 2 is a perspective view of a modified hair styling device which embodies the features of the invention;

FIG. 3 is a perspective view of yet another modified hair styling device in accordance with the invention; and FIG. 4 is a perspective view, partly broken away, of still another hair styling device embodying the features of the invention.

DESCRIPTION OF THE PREFERRED EMBODIMENTS

Figure 1:
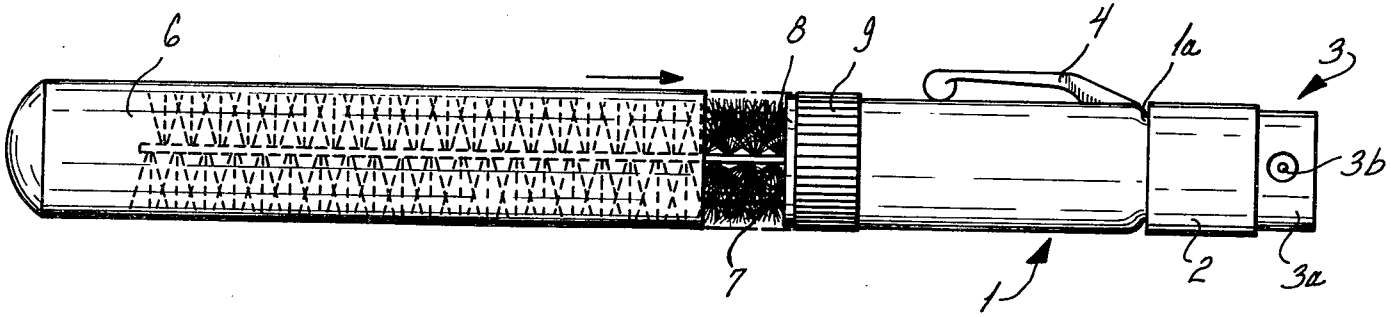
FIG. 1 is a longitudinal view, partly in section, showing a hair styling device embodying the features of the invention.

Before explaining the invention in detail it is to be understood that the invention is not limited in its application to the specific details of construction and arrangement of parts illustrated in the drawings since it is capable of other embodiments and of being practiced or carried out in various ways. It is also to be understood that the phraseology or terminology employed is for the purpose of description only and not of limitation.

Referring to the drawings, in which like reference numerals have been employed throughout to indicate like elements, there is shown a hair styling device H which has an external appearance similar to that of a pen. Typical dimensions for the device are 7–8 inches in length and $\frac{3}{4}$ to 1 inch in diameter. It will be appreciated, however, that the dimensions are not critical and may be varied from the range of sizes mentioned, particularly since the device does not utilize an aerosol cartridge and, therefore, is not limited to the provision of a compartment which must be of a size to receive commercially available aerosols. The device includes a handle 1 which is hollow and thereby serves as a container for a liquid. The liquid may be, for example, a liquid which is useful in the styling of hair such as a hair setting lotion or water. In the embodiment shown in FIG. 4, to be described in greater detail subsequently, the handle is divided into a pair of containers each of which may be provided with a different liquid as desired.

The handle or container 1 has an open end 1*a* through which liquid may be charged when required. A cap 2 surmounts the open end 1*a* to close same. A conventional pump and nozzle assembly 3 is supported by cap 2. Since the pump and nozzle assembly is conventional and may be found on many currently used household products it will not be described in detail herein so as not to unnecessarily encumber this specification. Thus, as is well known, a tube 5 (as shown in FIG. 3) extends into the container and the top of the assembly 3 includes a push button 3*a* to effectuate a pumping of liquid from the container. The liquid is discharged from the nozzle 3*b* in the form of a spray. A clip 4 of the type commonly found on pens may be secured to the exterior of the handle 1 for convenience in clipping the device onto a pocket or other suitable carrying means which serves as a support surface. A hollow cover 6 is desirably provided for disposition over a hair manipulative member 7 which is depicted in the various views as being either a brush or comb. The brush shown in FIG. 1 is affixed to and extends from the closed end of the handle 1. As shown in this figure the brush and handle possess a cylindrical configuration. The brush and handle of FIGS. 3 and 4 are similarly configured. It will be appreciated, however, that other configurations may be employed.

The brush is protected by cover 6 which is easily slipped over same for securement over a collar 8 formed adjacent the closed end of the handle 1. The cover is preferably made of a flexible plastic or from a metal which is fabricated to have a sufficiently small cross-section to provide the requisite flexibility. The collar 8 may be formed from a resilient plastic material so as to facilitate reception of cover 6 thereon. The internal diameter of the cover 6, when unstressed, is slightly less than the external diameter of the collar 8 when unstressed. Such flexibility of the cover and resiliency of the collar thus enables the user to easily push the cover manually over the collar to be maintained in position thereon until the need arises to remove the cover at which time it may be pulled off the collar. A ribbed grip 9 may be formed on the handle in proximity to the closed end thereof and such grip assists the user in firmly holding the handle while manipulating the cover.

In FIG. 2 a comb is employed as the hair manipulative member 7. Although not specifically shown it will be understood that a cover may be provided for placement in protective relationship over the comb.

FIG. 3 illustrates a device similar to that of FIG. 1 except that the brush is in the form of a cylindrical casing 10 having the bristles 11 thereof projecting radially outwardly. It will also be observed that the handle thus extends within the casing so as to enable a more compact construction. In such construction the inner diameter to the casing and the outer diameter of the handle are selected to accomodate a sliding fit therebetween. The brush may then be removed from the handle and, if desired, replaced by a comb such as shown in FIG. 2. However, the comb of FIG. 2 may be permanently affixed to the end of the handle.

In FIG. 4 there is shown a brush member 7 comprising a cylindrical casing 10 and bristles 11 projecting radially therefrom. As previously described in connection with the brush of FIG. 3, the casing is dimensioned so as to be positionable slidably upon handle 1. However, in the embodiment of FIG. 4 the removability of the brush serves another purpose. It will be observed that handle 1 is constructed so as to provide a pair of chambers or containers 1*b* and 1*c*. A common end wall 12 separates the chambers from each other. The outer ends of the handle 1 are each provided with a cap that includes a pump and nozzle assembly 3. Each of the chambers may contain a different liquid. Thus, one of the chambers is positioned within the confines of the casing 10 whereas the other chamber extends therefrom to make accessible its pump and nozzle assembly. When it is desired to use the liquid in the other chamber the brush 7 is removed and positioned over the chamber containing the liquid not to be utilized at such time. It will be recognized that a construction of this form enables the user to choose between two different hair treatment liquids and nevertheless to have available a device which is surprisingly compact.

It will be appreciated, as mentioned earlier, that the configuration of the brush and handle may be cylindrical or otherwise. This is also true of the embodiments shown in FIGS. 3 and 4 where a sliding relationship between the casing of the hair manipulative member 7 and the handle 1 is possible. Thus, the complementary surfaces of the casing and handle may be of any suitable configuration. Although not shown it is entirely within the contemplation of the invention to employ a casing and handle with a polygonal cross-section.

Since the styling of hair involves a combination of operations where the brush or comb is applied to the hair and the liquid sprayed onto the hair in alternate sequences it will be recognized that the device of the invention, in combining the hair manipulative member and the liquid containing handle in a compact unitary article, is particularly convenient and adapted for ready portability and storage.

It will further be appreciated that the construction of the device in accordance with this invention obviates the necessity of resort to the use of aerosols with their attendant disadvantages. It will be understood also that, at the option of the user, the container or handle 1 may be used for liquids such as cologne, perfume or the like which may or may not have utility as hair treatment liquids thereby precluding the need to carry separately containers for such liquids. The embodiment of FIG. 4 is of particular value from this standpoint. The cap 2 is, in the preferred embodiment of the invention, constructed for screwing on and off. However, it will be understood that it can also be constructed so as to snap on and off the open end of the handle to allow easy filling of the container 1. Each stroke of the pump can provide 15 to 20 fine mist sprays, however, the capacity of the pump in this respect is not critical and may vary. The brushes and combs and the handles may be provided with cooperating threads so that different brushes and/or combs may be screwed on and off the same handle. The reservoir may be confined to the handle and the brush or comb nevertheless be hollow with the handle being telescopable into the brush or comb. The pump may be provided with a removable overcap to prevent accidental actuation of the pump.

While the invention has been described by reference to specific embodiments thereof, it is understood that the hereto appended definition of the invention in the claims is also to include all modifications, variations and alternatives which would be obvious to one of ordinary skill in the art.

What is claimed is:

1. A hair styling device comprising, an elongated handle member having a rigid hollow body divided into two chambers by a common end wall for storage of two kinds of liquid therein, said hollow body being open at longitudinally opposed ends thereof, each of said open ends communicating with a respective one of said chambers for permitting said chambers each to be charged with liquid, two cap members detachably fastened to said respective open ends of the hollow body, said cap members each having therein pump and nozzle assemblies for selectively spraying liquid from the chambers, and a hair manipulative member including an elongated hollow casing and bristles attached to the casing and extending outwardly therefrom, said hollow casing having at least one opening at a longitudinal end adapted for receiving therethrough either one of said two chambers of said handle member to be snugly and firmly engaged therewith, so that one of the chambers of the handle member is exchangably situated in the hair manipulative member and the other chamber extending outwardly therefrom is used as a handle of the device.

2. A hair styling device according to claim 1, in which said pump and nozzle assemblies are located in the cap members to be operated by pushing them in the longitudinal direction so that the handle member extending from the hollow casing can be grasped for hair manipulation.

* * * * *